United States Patent [19]

Nyquist

[11] 4,372,516

[45] Feb. 8, 1983

[54] SHELF MOUNTING BRACKET AND ASSEMBLY

[76] Inventor: Lawrence M. Nyquist, 3018 N. Spaulding, Chicago, Ill. 60618

[21] Appl. No.: 231,510

[22] Filed: Feb. 3, 1981

[51] Int. Cl.[3] ..... A47G 29/02

[52] U.S. Cl. ..... 248/235; 211/90

[58] Field of Search ..... 248/235, 222.2, 222.3, 248/220.4, 221.1; 211/90; 403/206

[56] References Cited

U.S. PATENT DOCUMENTS

| | | | |
|---|---|---|---|
| 1,144,440 | 6/1915 | Staples | 403/206 X |
| 2,884,221 | 4/1959 | Messier | 248/221.1 X |
| 3,244,390 | 4/1966 | Kerr | 248/220.4 |
| 3,357,374 | 12/1967 | Smith et al. | 108/29 |
| 3,563,182 | 2/1971 | MacFarlane | 108/29 |
| 3,565,379 | 2/1971 | Messier | 248/221.1 |
| 4,285,484 | 8/1981 | Follows | 108/29 X |

*Primary Examiner*—J. Franklin Foss

*Attorney, Agent, or Firm*—Hume, Clement, Brinks, Willian & Olds, Ltd.

[57] ABSTRACT

A bracket assembly for cooperating with dry wall to provide a wall mount for a shelf or some other object. The bracket is fabricated of sheet material such as metal, has a side leg adapted to seat flush against the dry wall, and has at least two apertures formed through the side leg. Holes are formed through the dry wall in alignment with the apertures. At least two lever pins are inserted through aligned apertures and holes and then pivoted so that inner pin sections grip the dry wall when outer pin sections are snapped into retaining means on the side leg.

3 Claims, 7 Drawing Figures

FIG. 1
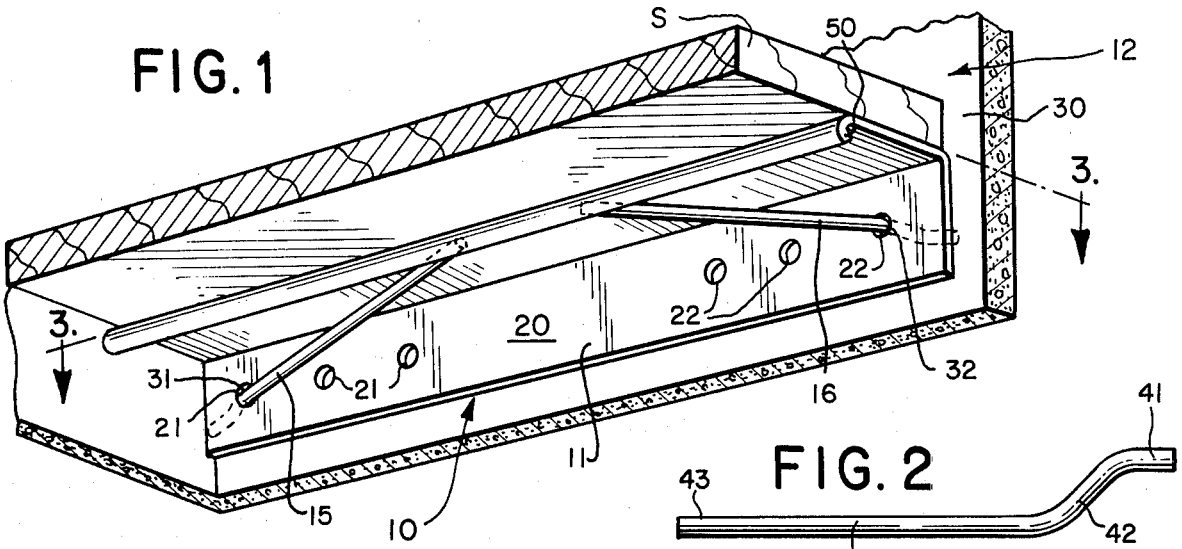
FIG. 2
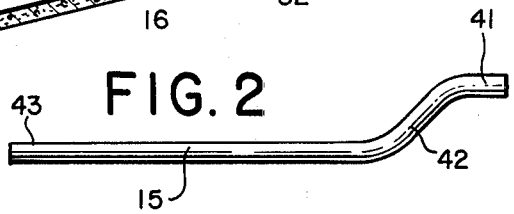
FIG. 3
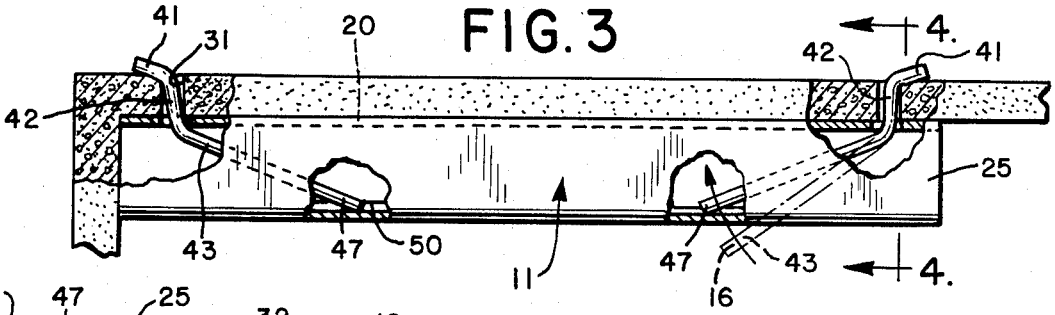
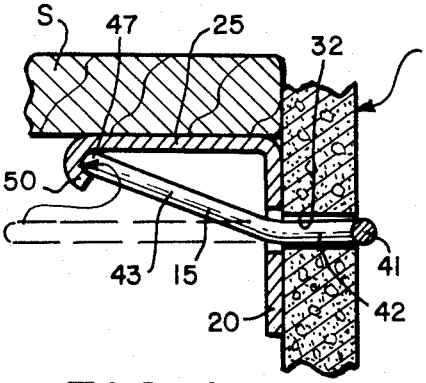
FIG. 4
FIG. 5
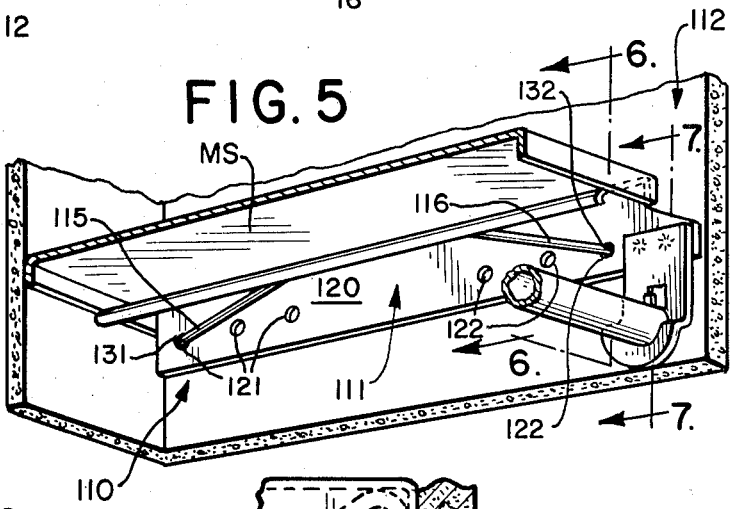
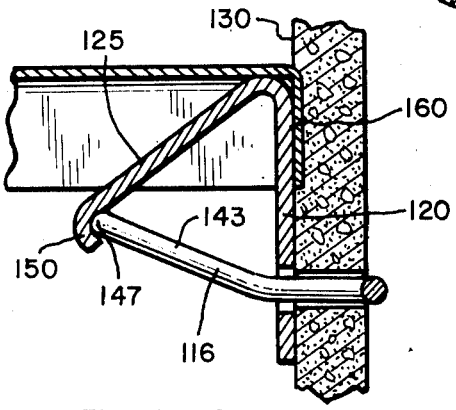
FIG. 6
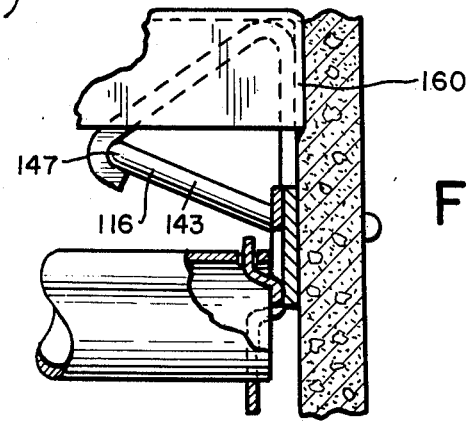
FIG. 7

SHELF MOUNTING BRACKET AND ASSEMBLY

FIELD OF THE INVENTION

The present invention relates generally to storage shelves for closets or the like. It relates particularly to a storage shelf mounting bracket and assembly for use on dry wall construction.

BACKGROUND OF THE INVENTION

Closet shelves were traditionally mounted on lath and plaster walls by nailing finished wood shelf mounting strips through the plaster into supporting studs. If a hanging rod was called for beneath the shelf, for example, rod support rings would be nailed to the side walls of the closet in similar fashion.

As will be recognized, this manner of mounting shelves is labor intensive. A carpenter must measure the wood mounting strips, cut them and then locate the studs. After positioning the mounting strips on the closet walls each strip must be nailed with a plurality of nails into the studs in the wall.

With the greatly increasing cost of labor, particularly in the construction industry, builders have sought construction components and methods which reduce the amount of labor required to build. One major breakthrough in the product area was the development of dry wall. Dry wall has virtually replaced lath and plaster construction in the building industry, as is well known.

There have not been great improvements in shelf mounting structures and techniques, however. Some developments do purport to reduce labor costs in mounting shelves while achieving a high quality product but they leave much to be desired. One involves brackets with teeth on them which are pressed against opposite side walls in a closet, for example, the teeth being forced into the dry wall. A shelf rests on lips extending inwardly of the brackets and is effective to prevent the brackets from pulling out of the walls. These brackets have a tendency to come loose, however, and are considered barely adequate by contractors.

SUMMARY OF THE INVENTION

An object of the present invention is to provide a new and improved shelf mounting bracket and assembly for use with dry wall. Another object is to provide a new and improved bracket and assembly for use with sheet metal shelving as well as wood and particle board shelves. A further object is to provide a shelf mounting bracket and assembly which is prefabricated and simple to mount yet remains firmly anchored on the wall for virtually as long as desired; nevertheless, it can easily be removed. It is still another object to provide a shelf mounting bracket and assembly which is simple and inexpensive.

The foregoing and other objects are realized in accord with the invention by providing a mounting bracket fabricated of sheet material such as metal or plastic or the like. The sheet material is formed into a horizontally elongated member having a vertical side leg adapted to lie flat against the dry wall. The member also includes a top leg which extends inwardly from the upper edge of the side leg; i.e., away from the dry wall. At horizontally spaced locations in the side leg at least two mounting holes are formed through the side leg.

A bracket is placed against the dry wall in a closet, for example, with the top leg extending horizontally.

Holes are punched through the dry wall in alignment with the mounting holes in the members side leg. Lever pins are inserted through the mounting holes in the side leg, into and through the side wall holes.

The lever pins include an inner end section which is designed to extend behind the dry wall, a central section which remains in the dry wall hole, and an outer end section which is designed to protrude inwardly of the mounting hole through the bracket's side leg. These sections are angularly arranged relative to each other so that when the lever pin is positioned in the aforedescribed manner, and the outer end section pressed toward the brackets side leg, the inner end section reacts by pressing firmly against the inside surface of the dry wall. The free tip of the outer end section on the lever pin is resiliently deformed to the point where it can be slipped under a lip formed on the free edge of the top leg in the bracket, where it is retained.

At least two lever pins are mounted in this manner. According to the invention the pins are inserted in oppositely oriented relationship so that the outer end sections extend generally horizontally toward each other or, in the alternative, generally horizontally away from each other. It is important only that they extend in opposite directions so as to permanently lock the bracket to the dry wall in such a way that horizontal movement of the bracket during the service life of the assembly is forestalled.

BRIEF DESCRIPTION OF THE DRAWING

The invention, including its construction and method of operation, together with additional objects and advantages thereof, is illustrated more or less diagrammatically in the drawing in which:

FIG. 1 is a perspective view of a storage shelf mounting bracket and assembly mounted on dry wall, the bracket and assembly embodying features of a first form of the present invention;

FIG. 2 is a plan view of a pin component in the assembly of FIG. 1;

FIG. 3 is a view taken along line 3—3 of FIG. 1;

FIG. 4 is a view taken along line 4—4 of FIG. 3;

FIG. 5 is a perspective view of a mounting bracket and bracket assembly embodying features of a second form of the present invention;

FIG. 6 is a view taken along line 6—6 of FIG. 5; and

FIG. 7 is a view taken along line 7—7 of FIG. 5.

DESCRIPTION OF THE PREFERRED EMBODIMENT

Referring now to the drawings, and particularly to FIGS. 1–4, a shelf mounting bracket and assembly embodying features of a first form of the present invention is illustrated generally at 10. The assembly 10 includes a bracket member 11 which is mounted tightly against the dry wall 12. The mounting bracket member 11 is preferably fabricated of sheet metal but it might also be molded of plastic or some other sheet material. The dry wall 12 is, in the present illustration, standard one-half inch (½") thick dry wall but it could be thicker or thinner.

The shelf mounting bracket and assembly 10 further includes two lever pins 15 and 16. The pins 15 and 16 extend through the bracket member 11 and the dry wall 12 and releasably but firmly lock the bracket member to the wall in a manner which will hereinafter be discussed. A pair of shelf mounting brackets and assemblies 10 affixed to opposite walls in the closet are utilized to support a wood or particle board shelf S in a well known manner.

Referring now specifically to the bracket member 11, it includes a vertical side leg 20 which is preferably seven-eighths of an inch ($\frac{7}{8}$") in height. In the present illustration the bracket member 11 is one foot (1') long since this is the width of the shelf which it will support. As will be recognized, longer bracket members 11 may support wider shelves, in which case the assembly 10 is modified as hereinafter described to accommodate the wider shelves.

The side leg 20 has a horizontally spaced series of three apertures 21 formed in it adjacent one end of the leg and a horizontally spaced series of three substantially identical apertures 22 formed in it adjacent the other end. The apertures 21 and 22 are spaced at approximately one and five-eighths inches ($1\frac{5}{8}$") intervals and preferably are one-quarter inch ($\frac{1}{4}$") in diameter.

Extending inwardly from the upper edge of the side leg 20 is a top leg 25. The top leg 25 is preferably five-eighths of an inch ($\frac{5}{8}$") in width. A downwardly and inwardly turned lip 50 one-quarter inch ($\frac{1}{4}$") in width is formed at the free edge of the top leg 25.

To mount the bracket member 11 on the dry wall 12 the member is held against the wall with the side leg 20 flush on the outer surface 30 of the wall. At this point a three-sixteenth inch (3/16") hole 31 is formed through the wall 12 in alignment with at least one of the set of apertures 21 in the bracket side leg 20. Another hole 32 is formed through the wall 11 in alignment with at least one of the set of apertures 22 in the side leg 20. The holes 31 and 32 may be formed by drilling but, from a practical standpoint, they are most often formed with a pointed awl driven through two of the apertures 21 and 22 and the wall 11 to form corresponding holes 31 and 32.

Then lever pins 15 and 16 constructed according to the invention, are forced through the bracket member apertures 21 and 22 and the dry wall holes 31 and 32, as seen in FIGS. 1 and 2. The lever pins 15 and 16 are rotated toward the wall 12 in oppositely oriented relationship to lock the bracket member 11 against the wall.

Referring to FIG. 2, the lever pins 15 and 16 are identical to each other, so only one will be described in detail. The pin 15 is formed of alloy steel wire which is one-eighth of an inch ($\frac{1}{8}$") in diameter. It includes an inner section 41 three-eighths of an inch ($\frac{3}{8}$") long, a central section 42 which is one-half inch ($\frac{1}{2}$") long and disposed at an angle of 55° to the inner section, and an outer section 43 two and one-eighth inches ($2\frac{1}{8}$") long which is, in turn, disposed at an angle of 55° to the central section. As will be seen the inner section 41 and the outer section 43 thus extend parallel to each other.

A pin 15, for example, is used by inserting it through one of the leg apertures 21 and the dry wall hole 31. The pin inner section 41 passes through both and the central section 42 remains in the corresponding aperture 21 and hole 31. In this relationship the outer section 43 protrudes from the wall in front of the bracket leg 20.

The pin 15 is rotated until the outer section 43 extends generally in the same direction as the length of the bracket member 11, facing toward either end. The outer pin section 43 is then pressed toward the wall 12 and bracket side leg 20, causing the inner pin section 41 to be forced tightly against the inner surface of the dry wall. The pin 15 thus acts as a lever, pivoting about its central section 42, forcing the inner pin section 41 to engage the dry wall 12 with great force.

The effect of this action is to grip the dry wall 12 tightly between the pin inner section 41 and the bracket side leg 20 against which the pin outer section (adjacent the middle section 42) now impinges. The pin outer section 43 is of such length that its free end 47 does not come underneath the bracket top leg 25 until the section 43 begins to resiliently bend under continued loading, further pivoting having been stopped by engagement of the pin inner section 41 against the dry wall.

When the free end 47 of the pin outer section 43 does come underneath the bracket top leg 25 it is snapped in behind a depending lip 50 on the top leg. The lip 50 is formed downwardly and back toward the bracket side leg 20 for a distance; i.e., lip width, of one-quarter of an inch ($\frac{1}{4}$"). As a result the pin end 47 cannot slip out from locking relationship under the lip 50 once it is manually seated.

The pin 16 is inserted in the same way; i.e., the same way but with its outer leg 43 extending in the opposite direction. In fact, it is simple and fast to insert both pins 15 and 16 at the same time; with two hands, so to speak. The bracket member 11 is thus locked against movement in either direction (longitudinally of the member) as well as away from the wall 12.

The bracket member 11 mounting and locking has been achieved simply and quickly. Furthermore, it can be removed equally as simply and quickly. As long as the free ends 47 of the pins remain under the lip 50, however, the bracket member 11 remains firmly locked to the wall 12.

Mounting of the bracket member 11 has been described in terms of only two pins 15 and 16. When longer bracket members 11 are used for wider shelves, however, two or three horizontally spaced pins 15 are used as well as a corresponding number of pins 16. A substantially greater holding force desirable for a wider shelf which might support more household goods, for example, is the result.

Referring now to FIGS. 5–7, a shelf mounting bracket and assembly embodying features of a second form of the present invention is illustrated generally at 110. The assembly 110 includes a bracket member 111 which is mounted tightly against the dry wall 112. Once again the mounting bracket member 111 is preferably fabricated of sheet metal while the dry wall 112 is standard one-half inch ($\frac{1}{2}$") thick dry wall.

Like the shelf mounting bracket and assembly 10, the shelf mounting bracket and assembly 110 includes two lever pins 115 and 116. They releasably lock the bracket member 111 to the dry wall in a manner substantially identical to that described in relation to the shelf mounting bracket and assembly 10. The shelf mounting bracket and assembly 110 is employed to mount a formed sheet metal shelf MS rather than a wood or particle board shelf, however, and is modified to accommodate that type of shelf construction.

The bracket member 111 includes a vertical side leg 120 which is preferably one and three-eighths of an inch ($1\frac{3}{8}$") in height. The bracket member 111 is again one foot (1') long since this is the width of the shelf which it will support in the present illustration.

The side leg 120 has a horizontally spaced series of three apertures 121 formed in it adjacent one end of the leg and a horizontally spaced series of three substantially identical apertures 122 formed in it adjacent the other end. The apertures 121 and 122 are spaced at intervals similar to the apertures 21 and 22 hereinbefore discussed.

Extending inwardly and downwardly from the upper edge of the side leg 120 is a top leg 125. An angle of approximately 45° is defined between the top leg 125 and the side leg 120. The top leg 125 is preferably seven-eighths of an inch ($\frac{7}{8}$") in width. A downwardly and inwardly turned lip 150 one-quarter inch ($\frac{1}{4}$") in width is formed at the free edge of the top leg 125.

To mount the bracket member 111 on the dry wall 112 the member is held against the wall with the side leg 120 flush on the outer surface 130 of the wall. One-eighth of an inch ($\frac{1}{8}$") holes 131 and 132 are formed through the wall in alignment with corresponding apertures 121 and 122 in the bracket side leg 120. As best seen in FIG. 6, the apertures 121 and 122 are formed through the side leg 120 at a point below the level of the lip 150 on the free edge of the top leg 125.

Then lever pins 115 and 116 constructed according to the invention and identical to the pins 15 and 16 hereinbefore discussed are forced through the bracket member apertures 121 and 122 and the dry wall holes 131 and 132. The pins 115 and 116 are rotated toward the wall in oppositely oriented relationship to lock the bracket member 11 against the wall. When the free end 147 of each pin outer section 143 comes underneath the bracket top leg 125 it is snapped in behind the depending lip 150. As a result the pin ends 147 cannot slip out from locking relationship under the lip 150 once it is manually seated. The bracket member 111 is thus locked against movement in either direction (longitudinally of the member) as well as away from the wall 112.

With opposed bracket members 111 mounted in the aforedescribed manner, a telescoping sheet metal shelf MS of conventional construction is mounted on the brackets 111. Downwardly turned flanges 60 at each end of the shelf are forced downwardly between the wall 112 and the side leg 120 in a manner also illustrated in FIG. 6. The shelf is thus locked in placed on the brackets 111.

While several embodiments described herein are at present considered to be preferred, it is understood that various modifications and improvements may be made therein, and it is intended to cover in the appended claims all such modification and improvements as fall within the true spirit and scope of the invention.

I claim:

1. A bracket and wall combination comprising:

(a) a sheet of drywall;

(b) a bracket member having a side leg;

(c) said side leg being seated flush against the outer surface of said drywall;

(d) said bracket member also having a top leg;

(e) said top leg extending substantially the length of said side leg and protruding outwardly of said side leg to a free edge;

(f) lip means formed on said outer free edge of said top leg, substantially along its length, and inwardly toward said side leg;

(g) an aperture in said side leg and a hole formed through said drywall sheet in alignment with said aperture;

(h) pin means having an inner section, a middle section and an outer section having a free end;

(i) said pin means extending through said aperture and said hole and adapted to grip the sheet with its inner section when its outer section is pivoted about said middle section towards said side leg;

(j) said free end of said outer section being resiliently retained under said lip means with said inner section gripping said wall to hold said bracket tightly against said sheet.

2. The assembly of claim 1 further characterized in that:

(a) said top leg protrudes at an angle of less than 90° from said side leg.

3. The assembly of claim 2 further characterized in that:

(a) said top leg protrudes at an angle of approximately 45° to said side leg.

* * * * *